United States Patent [19]

Barth

[11] Patent Number: 4,865,248

[45] Date of Patent: Sep. 12, 1989

[54] POST OFFICE LOCKER

[75] Inventor: Douglas A. Barth, Allegany, N.Y.

[73] Assignee: American Locker Group Incorporated, Jamestown, N.Y.

[21] Appl. No.: 177,135

[22] Filed: Apr. 4, 1988

[51] Int. Cl.[4] ..... E05B 65/46

[52] U.S. Cl. ..... 232/24; 312/215; 70/339

[58] Field of Search ..... 232/24, 25, 26, 21; 312/215; 70/339, 337

[56] References Cited

U.S. PATENT DOCUMENTS

| | | | |
|---|---|---|---|
| 3,790,244 | 2/1974 | Stackhouse | 312/215 |
| 4,121,758 | 10/1978 | Bonner | 232/24 X |
| 4,161,274 | 7/1979 | Bishop et al. | 232/25 X |
| 4,416,413 | 11/1983 | Chester | 232/24 |
| 4,557,416 | 12/1985 | Stahl et al. | 232/24 |

*Primary Examiner*—Robert W. Gibson, Jr.

*Attorney, Agent, or Firm*—Bean, Kauffman & Spencer

[57] ABSTRACT

A post office locker allows for delivery and safe storage until pickup of packages in one or more storage compartments each fitted with an access door provided with a custodian lock under the sole control of a mailman and an access lock adapted to be operated for access door opening purposes by a key supplied by the mailman to an intended recipient of a package. The access lock features an improved latch device arranged to cooperate with the custodian lock for defining two separate latch positions in which the custodian lock is constrained against rotation towards its door locked position.

5 Claims, 2 Drawing Sheets

Fig. 4.
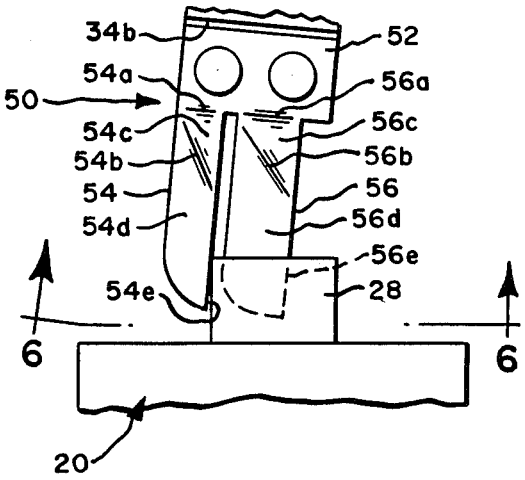
Fig. 5.
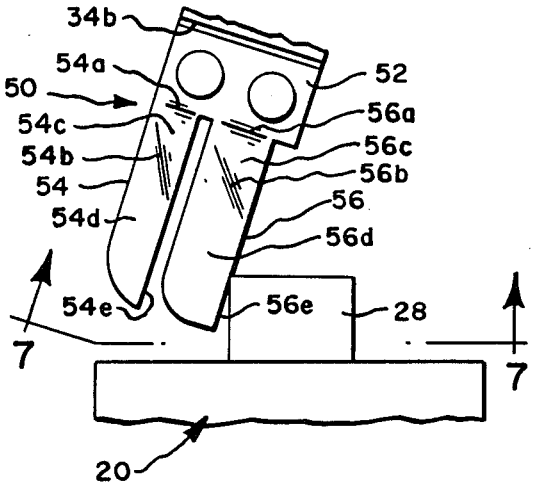
Fig. 6.
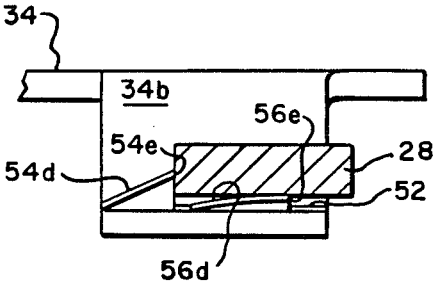
Fig. 7.
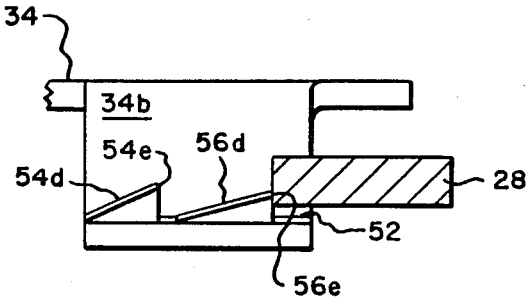
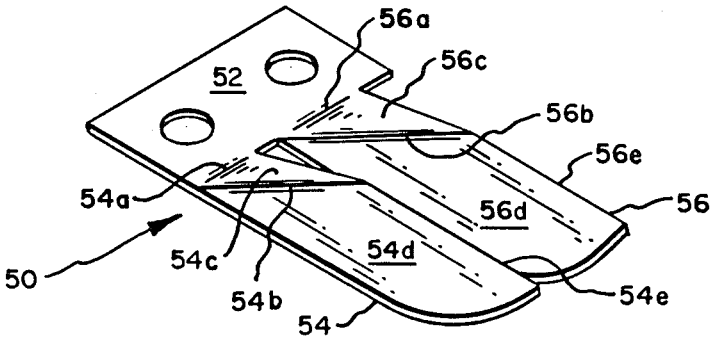
Fig. 8.

POST OFFICE LOCKER

BACKGROUND OF THE INVENTION

The delivery of a package mailed to a tenant of a multiple tenant building, such as an apartment house or office building, or to a person receiving mail at a centralized pickup point in a rural community, such as may be located for use by tenants of a trailer park, has been a time-consuming procedure both for the mailman charged with its delivery and for the intended recipient. In this respect, letter boxes normally provided for tenants of a multiple tenant building or trailer park are not of a size sufficient to receive medium to large size packages, and thus it has been necessary for the mailman to carry such packages directly to the door of the intended recipient. In the absence of the recipient, it is necessary for the mailman to return the package to the Post Office to await its personal pickup by the recipient.

A solution to the foregoing problem is offered by a mailbox unit of the type described in U.S. Pat. No. 3,790,244. In this patented unit, a plurality of large sized package storage cabinets are provided in proximity to a plurality of conventionally sized, key controlled letter boxes permanently assigned one to each tenant. The door of each storage cabinet is provided with a pair of key operated locks, namely, a custodian lock, which is operable by a key continuously retained in the possession of the mailman, and an access or recipient lock, which is over-controlled by the custodian lock for single-shot door opening operation by an access key placed in the temporary custody of an intended recipient of a package.

More specifically, when the mailman wishes to deliver a package, he places the package in one of the storage cabinets and then places its associated access key, which is appropriately numbered or otherwise marked in conformity with such cabinet, in the intended recipient's letter box. The presence of an access key in his letter box automatically advises the intended recipient that he has received a package and he then uses such key to open the door of the appropriate storage cabinet to gain access to his package. As the access key is turned to unlock the access lock in order to permit opening of the storage cabinet door, a latch device controlled by the custodian lock automatically locks the access lock in unlocked condition, with the result that its access key is "captured" or retained in the access lock. During a subsequent mail delivery, the mailman may reuse the now empty storage cabinet by placing another package therein and then employing his key to momentarily unlock the custodian lock in order to release the access lock for return to its cabinet door locked condition. The access key may then be removed and deposited in an appropriate letter box.

While a post office locker having a custodian lock-/access lock latching arrangement of the type described in U.S. Pat. No. 3,790,244 is quite effective for security purposes, it has not been placed in wide use, due to the insistence on the part of postal authorities that post office lockers of the general type described in this patent be fitted with an approved or standard custodian lock fitted with a lock housing mounting a reciprocating lock bolt. This requirement has resulted in the adoption in the industry of a decidedly different access lock latching arrangement, wherein a spring latch element, which is supported for rotation with the access lock, is arranged and shaped to resiliently override the lock bolt of the custodian lock, during rotation of the access lock towards door unlocked position and then to latchingly engage with such lock bolt to prevent return rotation of the access lock towards locked position, until operation of the custodian lock for purposes of momentary retraction of the lock bolt. Spring devices have sometimes been employed to normally bias the access lock towards unlocked position.

A drawback to the present industry accepted custodian lock/access lock latching arrangement is that on occasion such arrangement has been found to allow the access lock to be rotated towards its unlocked position sufficiently to permit opening of its associated door for package removal purposes prior to the point at which the spring latch element becomes effective for purposes of cooperation with the lock bolt of the custodian lock to prevent return rotation of the access lock to its locked position, whereat the access key can be removed from the access lock. Thus, on these occasions, it is possible to remove a package and then remove and retain/discard the access key, such that the package storage cabinet is rendered unusable until a new access lock/access key unit is installed. This failure in the present system may occur for various reasons including damage to the door or its surrounding frame, which permits premature separation of the lock bolt of the access lock carried on one of the door or frame from its cooperating locking flange or recess carried on the other of the door or frame. The problem is aggravated by the fact that manufacturers of post office lockers do not have control of the manufacture of the lock units required to be installed and thus it is difficult to accurately control manufacturing tolerances, as required to insure that unlocking of the door occurs only after the key of the access lock has been "captured" by the custodian lock.

SUMMARY OF THE INVENTION

The present invention relates to a post office locker for use in the delivery of mail, including packages, to a central pickup point serving a plurality of family or business units. More particularly, the present invention is directed towards an improvement in a custodian lock-/access lock latching arrangement of the type presently used in post office lockers, which insures "capture" of the key of the access lock before the access lock has been rotated sufficiently to unlock its associated storage cabinet door.

BRIEF DESCRIPTION OF THE DRAWINGS

The nature and mode of operation of the present invention will not be more fully described in the following detailed description taken with the accompanying drawings wherein:

FIG. 4 is a view similar to FIG. 3, but with the access lock disposed intermediate its locked and unlocked positions;

FIG. 5 is a view similar to FIG. 3, but with the access lock disposed in unlocked position;

FIG. 6 is a sectional view taken along the line 6—6 in FIG. 4;

FIG. 7 is a sectional view taken along the line 7—7 in FIG. 5; and

FIG. 8 is a perspective view of a spring latch.

DETAILED DESCRIPTION

Figure 1:
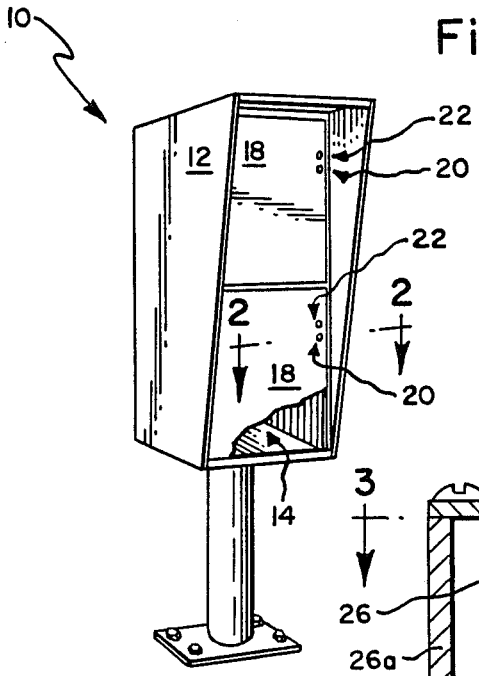
FIG. 1 is a perspective view illustrating one type of post office locker unit having storage cabinets with which the present invention may be utilized.

Reference is now made more particularly to FIG. 1. wherein a post office locker unit incorporating the present invention is generally designated as 10. Unit 10 is shown as being in the form of a package receiving unit and as including a housing 12 incorporating a desired number of package storage compartments 14 bounded in part by a stationary lock channel 16 and removably closed by hinge mounted access doors 18 each fitted with a custodian lock 20 and an access lock 22. Alternatively, access doors 18 may be fitted with individual lock channels or the like, not shown, and a pair of locks 20 and 22 carried by housing 12 adjacent each of such access doors. As desired, unit 10 may be positioned in the immediate vicinity of a separate mail receiving unit, not shown, incorporating a desired number of letter boxes assigned to individual tenants of a building or other family and/or business units using a common mail pickup point, or the size of unit 10 may be expanded to serve as both a package and mail receiving unit, such as is shown in U.S. Pat. No. 3,790,244 whose disclosure is incorporated by reference herein.

Figure 2:
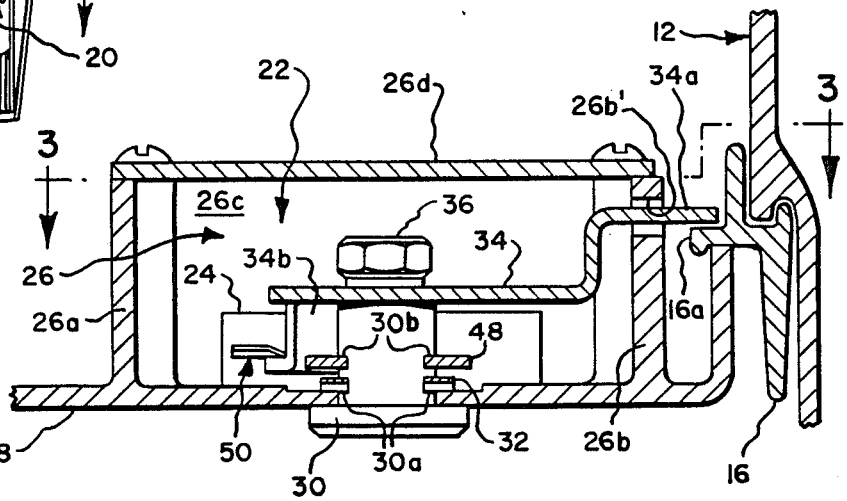
FIG. 2 is a sectional view taken along the line 2—2 in FIG. 1.
Figure 3:
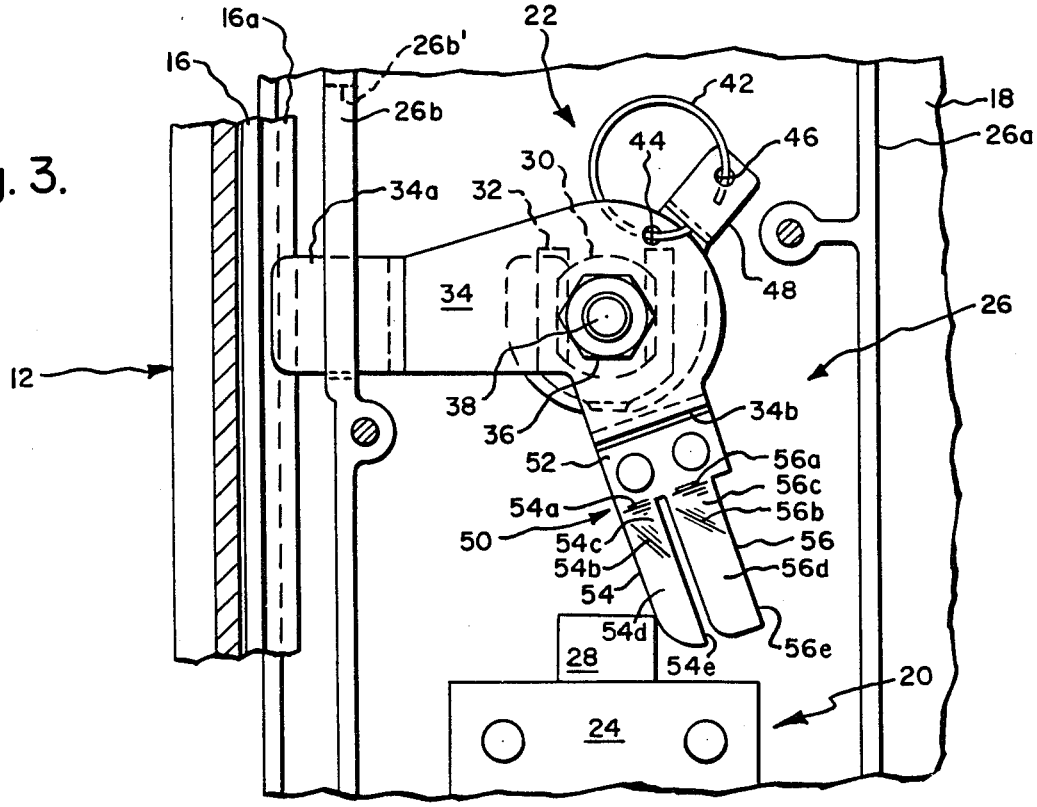
FIG. 3 is a sectional view taken along the line 3—3 in FIG. 2.

Custodian lock 20 is shown in part in FIGS. 1–3 as being of the type supplied by the U.S. Postal Service and as including a housing 24, which is suitably fixed to the rear surface of an associated door 18 within a rearwardly opening security recess 26 defined in part by the rear surface of the door, a pair of vertically extending side flanges **26*a* and 26*b* and end flanges, only one of which is shown at 26*c* in FIG. 2, formed integrally with such door and a rear cover plate 26*d*. Housing 24 serves to mount a lock bolt 28 for reciprocating movement between an extended or locked position shown in FIG. 3 and a retracted or unlocked position, not shown, under the control of a custodian key, also not shown, continuously retained in the possession of a mailman and removably insertable into a lock cylinder of the custodian lock 20, which projects forwardly through door 18**.

Access lock 22 is shown in FIGS. 1–3 as being of conventional construction from the standpoint that it includes a lock housing 30, which is non-rotatably fixed to project rearwardly through door 18 into security recess 26 and be retained in a door assembled condition by a spring clip retainer 32 received within housing wall recesses **30*a*; and a lock bolt 34, which is fixed via a nut 36 for rotation with a rearwardly projecting extension 38 coupled to a lock cylinder, not shown, supported in turn within housing 30 for rotation relative thereto under the control of an access key, also not shown, between access lock locked and unlocked positions depicted in FIGS. 3 and 5, respectively. In the illustrated installation, a free end 34*a* of lock bolt 34 is arranged to removably project through an access slot 26*b*′ formed in side flange 26*b* to removably overlie a lock flange 16*a* of lock channel 16 for purposes of locking door 18 in closed position, as shown in FIGS. 1 and 2. As is known, the access key may be removably inserted into access lock 22** only when the latter is disposed essentially in its locked position; such key being "captured" or retained within the access lock by its tumblers for all other rotational positions thereof.

In accordance with a preferred form of the present invention, access lock 22 is biased towards its unlocked position by means of a generally C-shaped torsion spring 42 having one end removably fitted within an aperture 44 defined by access lock bolt 34 and an opposite end removably fitted within an aperture 46 defined by a stationary, generally J-shaped spring mounting clip 48 received within housing wall recesses **30*b***.

Referring to FIGS. 2–7, it will be understood that in accordance with the present invention, access lock bolt 34 is provided with a depending, generally L-shaped flange **34*b* which serves to support a uniquely shaped spring latch 50 formed from a thin plate or sheet of spring steel or other suitable resiliently deformable material. Latch 50 is shaped to define a flat mounting plate portion 52 and a pair of generally parallel resiliently deformable projections or parts 54 and 56, which are arranged to extend from the mounting plate in a leading and trailing relationship with respect to the direction of rotation of access lock 18 from its locked position of FIG. 3 towards its unlocked position of FIG. 5. Projections 54 and 56 are shown in FIGS. 3–7, as being rearwardly bent relative to door 18 along transversely extending lines 54*a* and 56*a* and forwardly bent relative to the door along lines 54*b* and 56*b*, which are convergent or angularly related to such transversely extending lines, so as to define generally triangularly shaped inner end portions 54*c* and 56*c* and outer or free end portions 54*d* and 56*d*, which are angularly inclined or transversely tilted relative to mounting plate portion 52. The orientation of bend lines 54*b* and 56*b* differ, as viewed in FIGS. 3–5, such that the trailing or latching edge 54*e* of free end portion 54*d* is higher or spaced through a greater distance rearwardly of mounting plate portion 52 than the trailing or latching edge 56*e* of free end portion 56*d*, as shown in FIG. 7. However, both of trailing edges 54*e* and 56*e* are arranged, when projections 54 and 56 are in their respective non-deformed state or positions shown in FIG. 7, for latching or abutting engagement with custodian lock bolt 28 incident to rotation of access lock 18 in a direction extending towards its locked position. Further, each of projections 54 and 56 are capable of resilient deformation sufficient to permit same to "override" custodian lock bolt 28, as shown in the case of projection 56 in FIG. 6, incident to rotation of access lock 18** in a direction extending towards its unlocked position.

To facilitate description of the mode of operation of the present invention, it will be assumed that storage compartments 14 are empty; that doors 18 are closed, but with their access locks 22 in unlocked position and their custodian locks 20 in locked condition, such that the keys of the access locks are "captured" or retained within such locks; and that the keys for both the access locks and custodian locks 20 are the possession of the mailman assigned to deliver packages to unit 10 and mail to the mail receiving unit with which it is associated. The assumed positions of custodian locks 20 and access locks 22 are depicted generally in FIG. 5. It will be understood that the arrangement of parts is such that when access lock 22 is in its unlocked position the free end **34*a* of access lock bolt 34 is withdrawn from overlying engagement with lock flange 16*a* and preferably disposed within access slot 26*b*′ essentially flush with or recessed relative to the outwardly facing surface of security recess side flange 26*b*; and trailing edge 56*e* is disposed in abutting engagement with or in immediate proximity to custodian lock bolt 28**, as shown in FIGS.

5 and 7, in order to latch or constrain the access lock against rotation from its unlocked position in a counterclockwise sense, as viewed in FIG. 5. Preferably, the angular relationship between free end 34*a* and trailing edge 56*e* is such that projection 56 is operable to latch access lock 22 against rotation towards its locked position immediately after withdrawal of free end 34*a* from engagement with lock flange 16*a* in order to prevent any subsequent locking rotation of access lock 22, which might occur in the event of failure or unseating of torsion spring 42, and result in the temporary latching of door 18 in closed position.

When the mailman has a package for delivery to a tenant served by the mail receiving unit with which unit 10 is associated, he opens door 18 of an unoccupied storage compartment 14 and places the package therein. He then in sequence employs the custodian key to unlock custodian lock 20 for purposes of retracting lock bolt 28; employs the access key, which remains "captured" in access lock 22 to rotate the access lock to its locked position of FIG. 3; employs the custodian key to return the custodian lock to its initial locked position, withdraws both of the keys; and finally places the withdrawn access key in the appropriate tenant's letter box for purpose of apprising such tenant that the package is retained in the storage compartment, which bears identifying indicia corresponding to that appearing on the access key. The tenant intended to receive the package may then employ the access key to return access lock 22 to its initial unlocked position in order to permit opening of door 18 for package retrieval purposes.

It will be understood that as an incident to return of access lock 22 to its unlocked position, lock bolt 34 is caused to rotate from its locked position in a clockwise sense, as viewed in FIG. 3. During such clockwise rotation, free end portion 54*d* of projection 54 is immediately brought into camming engagement with custodian lock bolt 28, which results in resilient deformation of such projection sufficiently to permit same to "override" or move arcuately past the lock bolt, whereupon the projection is permitted to return to its initial nondeformed state to position its trailing edge 54*e* in alignment with the lock bolt, as shown in FIGS. 4 and 6. The placement of projection 56 in close trailing proximity to projection 54 results in free end portion 56*d* being brought into camming engagement with lock bolt 28 shortly after free end portion 54*d* is so engaged, in order to insure that free end portion 56*d* is disposed in resiliently deformed condition upon release of free end portion 54*d*, as indicated in FIGS. 4 and 6. Continued clockwise directed rotation of access lock 22 returns same to its initial unlocked position, whereupon projection 56 "overrides" lock bolt 28 and returns to its nondeformed condition, as indicated in FIGS. 5 and 7.

The provision of projection 54 is an important feature of the invention in that it insures that access lock 22 is committed for continued rotation towards its unlocked position, i.e. prevented from return rotation towards its locked position at which the access key can be removed therefrom, at a point where free end 34*a* of access lock bolt 34 is assured of overlying lock flange 16*a* for all conditions of lock unit 10 short of actual destruction thereof. Accordingly, the provision of a two-part latch device including projection 54 overcomes the prior problem encountered when only a single part latch device corresponding to projection 56 was provided, namely, the possibility that damage to/misalignment of door 18 and lock flange 16*a* may result in the removal of lock bolt 34 from engagement with lock flange 16*a* prior to the point at which the latch device was rotated sufficiently to "override" custodian lock bolt 28, such as would permit opening of door 18 for package removal purposes and subsequent return of access lock 22 to its locked position for purposes of removing and retaining/discarding the access key.

I claim:

1. In a post office locker permitting delivery and safe storage until pickup of packages to tenants, wherein the locker includes at least one package storage compartment accessible only to a given tenant to which a package is to be delivered and to a mailman, each said compartment having an access door, a tenant access lock movable between door locked and unlocked positions for permitting access to its associated compartment by means of an access key placed in the temporary possession of said given tenant by the mailman, said access lock permitting said access key to be inserted into and/or removed therefrom only when said access lock is in said locked position, a custodian lock having a lock bolt movable between a normal locked position and an unlocked position by means of a custodian key in the possession of said mailman, and resiliently deformable latch means, said latch means arranged for engagement with said lock bolt when in said locked position thereof and cooperating therewith for preventing rotation of said access lock from said unlocked position thereof in a direction towards said locked position thereof, while permitting rotation of said access lock from said locked position thereof into said unlocked position thereof, the improvement comprising in combination:

said latch means including first and second parts disposed in a leading and trailing relationship relative to each other in the direction of rotation of said access lock towards said unlocked position thereof and successively engaging and cooperating with said lock bolt for preventing rotation of said access lock from a position intermediate said locked and unlocked positions thereof and said unlocked position thereof in said direction towards said locked position thereof.

2. The improvement according to claim 1, wherein said access lock includes a lock bolt and said latch means is carried by said lock bolt of said access lock.

3. The improvement according to claim 2, wherein said first and second parts are formed integrally with a common mounting portion fixed to said lock bolt of said access lock.

4. The improvement according to claim 3, wherein said first and second parts and said mounting portion are formed from a plate of resiliently deformable material and said parts extend from said mounting portion in a generally parallel relationship, said parts each being bent along a pair of convergent lines to define generally triangularly shaped inner end portions disposed adjacent said mounting portion and outer end portions disposed in an angularly inclined relationship to said mounting portion, and said outer end portions have trailing edges arranged for abutting engagement with said lock bolt of said custodian lock for preventing rotation of said access lock towards said locked position thereof.

5. The improvement according to claim 4, wherein said trailing edge of said first part is spaced from said mounting portion through a greater distance than said trailing edge of said second part.

* * * * *